4/5/84 OR 4,440,019

United States Patent [19]

Marshall

[11] 4,440,019

[45] Apr. 3, 1984

[54] FREE POINT INDICATOR

[76] Inventor: W. Ray Marshall, 12702 Crow Valley St., Houston, Tex. 77099

[21] Appl. No.: 383,178

[22] Filed: May 28, 1982

[51] Int. Cl.[3] ..... E21B 47/00

[52] U.S. Cl. ..... 73/151

[58] Field of Search ..... 73/151; 324/221, 220, 324/228, 229, 239

[56] References Cited

U.S. PATENT DOCUMENTS 2,902,640 9/1959 Foster ..... 324/221

2,946,926 7/1960 Hawthorne ..... 324/221 X

*Primary Examiner*—Jerry W. Myracle

*Attorney, Agent, or Firm*—Roy H. Smith, Jr.

[57] ABSTRACT

The components for operation of the invention are three: (1) a downhole tool consisting basically of a sensitive coil suitably protected by an encasing sheath as it is run downhole inside a string of drill pipe, tubing or the like, (2) surface apparatus to pulse the coil by discharging a capacitor through it, and later to detect small voltages induced in the coil as a result of running it past magnetic spots in the string produced by the capacitor discharges, and (3) connecting elements for both running and pulling the downhole tool, e.g., a wire line, and for electrically connecting the coil to the surface apparatus.

Such apparatus is used in conjunction with standard equipment at the wellhead to stress the string by either pulling up on it or trying to rotate it, or both. In trying to pinpoint the depth at which the string is stuck, use of the invention exploits the fact that the lifting or torqueing force will cause strains in the material of the string along its entire free length, but no strains will be induced in the portion below the point of sticking. Also exploited is the fact that thus stressing the free part of the string will erase all magnetic spots previously placed there by pulsing the downhole tool. Since no stresses are produced below the point of sticking ("free point"), magnetic spots below such point will remain, and are detected as the tool travels past them.

10 Claims, 3 Drawing Figures

FREE POINT INDICATOR

FIELD OF INVENTION

The present invention belongs in that group of tools that might be called downhole analytical tools, i.e., tools run into a wellbore to obtain some sort of information about the formation, or the condition of the tubular string in which the tool is employed. More specifically, the invention is employed primarily as a free point indicator or detector. This is the point in the wellbore where the string of pipe or tubing has become stuck, and it is important to know the location of this point as accurately as possible.

BACKGROUND AND PRIOR ART

In the various operations which take place in a wellbore—drilling, completion, fracturing, workwover, etc., it sometimes happens that a string of pipe or tubing which is supposed to be freely pullable becomes tightly stuck, and all efforts to free it by lifting and attempting to rotate it fail. In such event, it is typically necessary to sever the pipe at the free point, so that the free portion thereabove may be removed and salvaged. In order to salvage as much of the length as possible, the operator needs a rather precise idea of such length, which of course is the depth of the free point.

Heretofore there have been relatively few devices available to detect the free point of a string which is stuck in the hole. The best known such device, marketed by the DiaLog Tubular Survey Co., is described in U.S. Pat. No. 3,004,427, issued in 1961 to T. L. Berry. The Berry apparatus includes a downhole tool whose main element is a variable inductor, made variable by the fact that it has a 2-part iron core. The tool is set in place by belly springs above and below the inductor, the belly springs securing the entire tool to the inner wall of the string. When first set in position, the core parts are in a closed position which furnishes a particular reading to a galvanometer in the electrically connected surface equipment. The string is then stressed by an upward pull or a torque, and if the tool is located in the free part of the string the upper core half pulls away from the lower core half, changing the inductance and giving a different reading in the surface instrument. Since this depth is thus known to be free, the operator then lowers the tool and repeats the same steps at progressively deeper positions until he reaches one where the core parts do not separate. He then knows that his tool is in the stuck area.

While the Berry tool has worked admirably, it is an intricate and expensive tool. It has little in common with the present invention other than making use of the fact that the free part of the string will yield slightly under a tensile load, while the stuck portion will not.

BRIEF SUMMARY OF THE PRESENT INVENTION

The present inventor has taken a completely different approach, basing his apparatus on the fact that even drill collars, the heaviest members of a drill string, can be marked with magnetic spots, somewhat in the manner that reproducible markings may be impressed on a magnetic tape in a sound recording device. While it has been known that reels of wire and sheet metal may be thus marked, the customary procedure is to run the wire or sheet metal through a stationary "marking head," which is actuated periodically to spot the material at predetermined lengths. The present inventor reverses this procedure by incorporating a marking head into his downhole tool and running it throughout the bore of a long string of tubular members which are, unfortunately, fixed in place.

The present inventor has also discovered that the magnetic spots induced in the string by pulsing his downhole tool, consisting basically of a wire coil described by way of example in the detailed description below, may be mechanically erased by very slight elongation strains. He puts this phenomenon to good use by a technique involving the sequential steps of (1) producing a successions of magnetic spots in the inner wall of the string at progressively deeper locations by discharging a surface capacitor bank through the downhole coil, (2) lifting the string by pulling up on it from the surface, thus stressing it in tension and causing slight temporary strains in the part of the string lying above the free point, and (3) running the same downhole tool past all the previously emplaced magnetic spots, but this time with the coil connected to sensitive surface instrumentation which will react each time the coil has a slight voltage induced in it as a result of its movement through the field of each magnetic spot which has not been erased by the string-lifting step. Assuming that the succession of magnetic spots produced in the initial steps spanned the free point, the locating of such point is then just a matter of analyzing the logs which were made for each pass of the running tool. If there were five such spots at the start and the upper three have been erased while the 4th and 5th spots remain, the operator knows that the free point lies between the 3rd and 4th spots, and can read its depth range from the depth scale on his logs.

The technique just described can be varied by torqueing the string rather than lifting on it, and can sometimes be refined by doing both successively to locate the free point more precisely. If the process just described in connection with a lifting step were to be followed by a torqueing step, for example, one or more of the uppermost spots may well be erased—even though ordinary lifting left them unexpunged. This happens because a wellbore is seldom completely vertical throughout its full depth, and consequently the string of tubular members may have a bend in it, in the location of concern. As anyone who has ever run a plumber's "snake" through a drain line is aware, this type of flexible cable may get hung up as a result of being run through a 90-degree elbow, to the extent that it can not be retracted by simply pulling on it; at the same time it can be readily rotated, from the handle end of the device, throughout its length. The downhole string may have the same experience at a somewhat slighter bend in the wellbore, and as a result the true free point may lie below such bend. If so, the application of a rotary force will erase a magnetic spot below such a bend to furnish a more accurate location of the free point.

The present inventor has also discovered that his apparatus is capable of detecting certain things without utilizing its capability to cause magnetic spots. One such item lies in the uneven thickness of the string, particularly the considerably greater thickness of the connections of the members, tool joints and drill collar connections in particular. He has discovered that when the surface instrumentation is set in the detection mode, i.e., with voltages in the traveling coil being read on the instruments, the needle will kick each time the coil passes a drill collar connection. This gives the operator a benchmark for all other operations; for instance, where the string is going to be severed by detonating an explosive charge, the operator can locate the detonation between connections, where the wall to be severed is thinner. Whatever the explanation of this phenomenon may be, and the present inventor has no such explanation to offer, it is absolutely verifiable and of considerable advantage to those working the wellbore.

GENERAL DESCRIPTION OF THE DRAWING

The present invention will be more easily comprehended by reference to the attached drawing, in which.

DETAILED DESCRIPTION OF THE DRAWING

Figure 1:
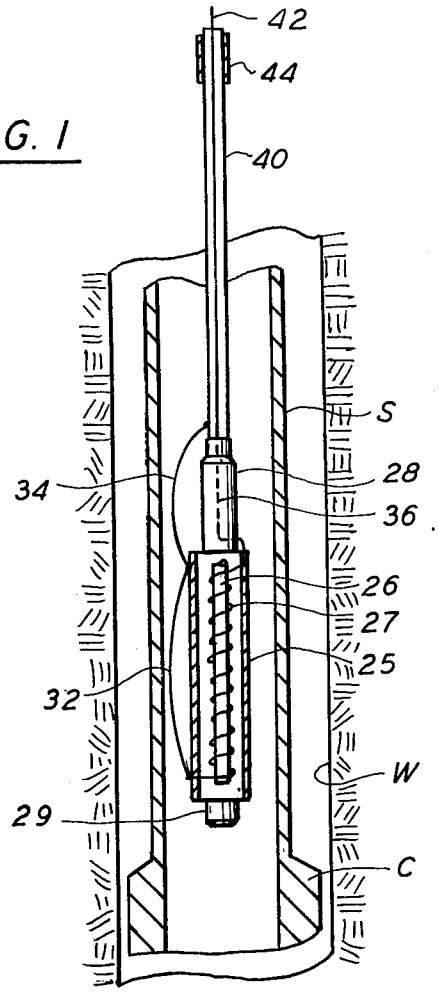
FIG. 1 is a schematic cross-section of the downhole tool of the invention as it might appear within a tubular string in a wellbore.

The downhole tool 25 of the invention is illustrated schematically in FIG. 1, and is basically a winding or coil 27 which may be wrapped on a soft iron core 26. The material covering winding 27 and lying between the winding and the illustrated outer surface of tool 25 is insulating material, preferably including for mechanical strength a case of a non-magnetic metal such as Monel metal or stainless steel. The major purpose of this material is to protect the coil from abrasion against the inner wall of the string S of tubular members. Such string S may, for instance, be a drill string wherein adjacent members are screwed together at connections such as C, which are considerably thicker than the rest of the pipe. The string S is shown in an in situ position in a wellbore W.

The upper part 28 and lower part 29 of the illustrated tool are mechanical connectors, the upper connector 28 serving to connect the coil or inductor member 25 with the wire line 40 while lower connector 29 connects coil member 25 with additional tools not shown which may be suspended below the coil, e.g., an explosive charge used to sever the string, during a later operation.

Wire line 40 is an electro-mechanical cable having the suggested dual purposes, first of mechanically supporting the tool 25 and anything suspended from this tool, and second to serve as a wire connection between the coil and surface equipment used to energize the coil and detect any induced voltages in it. It is preferably a coaxial cable with a conductive copper core 42, spaced by an appropriate annulus of insulating material from a case 44 of high strength steel strands braided around the core in the manner of a wire rope. For electrical purposes, case 44 also serves as the ground or return conductor, as symbolized in FIG. 1 by the jumpers 32 and 34 which connect the lower end of winding 27 to case 44. The upper end of winding 27 is connected to the core conductor 42 by the connector 36 shown in phantom.

Figure 2:
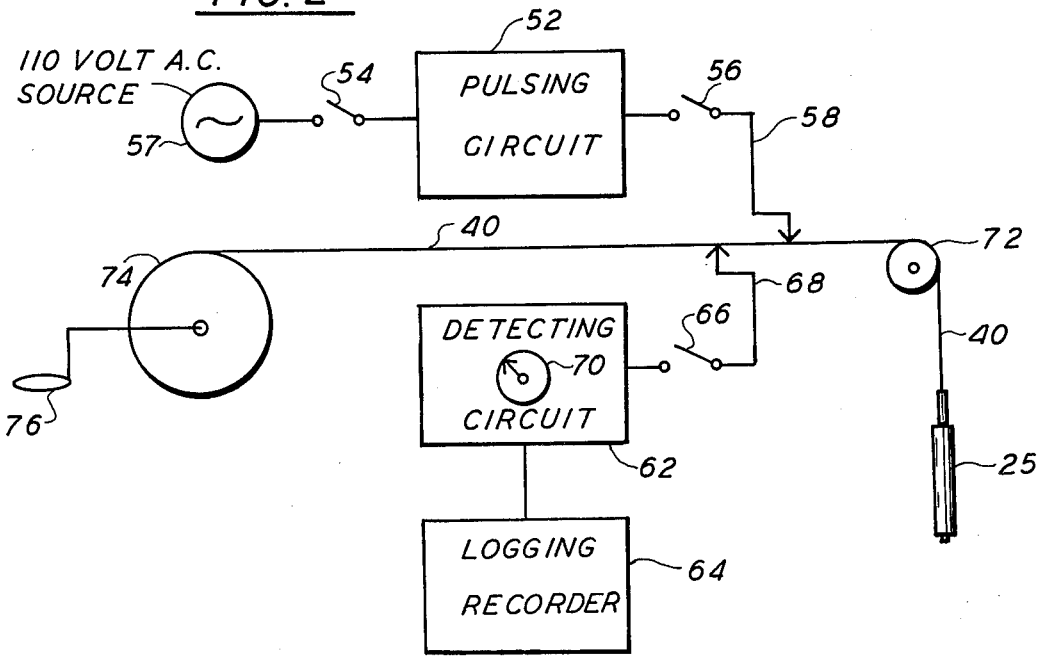
FIG. 2 is a block diagram schemaic of the surface electrical equipment associated with the downhole tool of the invention.

FIG. 2 schematically illustrates the surface electrical equipment connected to and used in conjunction with the downhole tool 25. Mechanically, the wire line is dispensed from a drum 74, which is usually truck mounted; the member 76 shown in the shape of a hand crank symbolizes means for dispensing and re-winding cable 40 onto the spool or drum 74. Not shown are mechanical counting means connected to the drum mechanism for measuring the length of cable passing from the drum.

The cable 40 passes over appropriate pulleys symbolized by 72 and then vertically downward into the wellbore W, as shown. When the operator decides that downhole tool 25 has reached the appropriate depth, he may preliminarily make use of the detecting circuit 62 and logging recorder 64, although this step is not essential. When used, the operator closes switch 66, connecting circuit 62 to the cable 40 through the slip ring connector 68. He then lowers and raises the downhole tool 25, in the vicinity suspected to include the free point of the stuck drill string. As the coil 25 passes through each drill collar (or tool joint) connection C, the galvanometer 70 of detecting circuit 62 will flicker, and at the same time the recording pen of logging recorder 64 will move laterally to leave one of the marks "A" of the log 1 shown in FIG. 3. A series of these are obtained to provide benchmarks for further work. Switch 66 is then opened.

The operator then closes switch 54 to connect the pulsing circuit 52 to an appropriate source of electrical power 57, which can be the commonly available 110 volt, 60 hertz source. The downhole tool is positioned, and switch 56 is closed to provide a pulse of electrical energy which travels through slip ring 58 and the length of cable 40 to the coil 25. This transient pulse through the coil causes it to radiate a burst of magnetic energy which leaves a magnetic spot or band B in the wall of drill string S surrounding the location of coil 25 at that time, and of about the same length as the coil. Such steps of alternately charging and discharging the pulsing circuit 52 are repeated for various additional depth locations of the tool 25 to obtain a series of marks B.

The pulsing circuit 52 is basically a capacitor bank, together with a suitable charging circuit to convert the alternating current supply to direct current, and controls to discharge the capacitor bank into the wire line. Each of the slip rings 58 and 68 are actually connected to the cable 40 at the drum 74 so that all pulses pass through the complete length of the cable, including all of that portion which remains wound on the drum. This assures that the load impedance for either circuit will remain more or less constant.

Having made what he considers to be an adequate number of magnetic marks in the string, the operator then disconnects pulsing circuit 52 from wire line 40, and connects detecting circuit 62 and logging recorder 64 by closing switch 66. The downhole tool is raised and lowered, and during this pass the galvanometer 70 will flicker each time tool 25 passes one of the magnetic marks. Such excursions of the galvanometer needle will cause the pen of the recorder to generate a second set of pips, indicated as "B" on Log 2 of FIG. 3. In this particular log the operator managed to make a magnetic spot between each pair of adjacent drill collar connections, i.e., between marks "A" on the log.

Having made such spots, the operator's next step is to see how many of them he can erase—not electrically but mechanically. Between Logs 2 and 3 both circuits are disconnected from the wire line, and the operator causes a lifting force to be exerted on the drill string S equal to about 1⅓rd times the total weight of the string, for example about 80,000 pounds for a string weighing 60,000 pounds. Such lifting force is provided by the conventional equipment on the derrick and drill floor, and is opposed by an equal force exerted by the tight grip of the earth formation binding the drill string—at the free point. All parts of the string above the free point will experience a slight strain or elongation, but however slight it is sufficient to erase the magnetic marks.

On the other hand, that part of drill string lying below the free point does not experience the tensile loading, and hence does not elongate. Any and all magnetic marks "B" below the free point are not affected, and will be detected by a further pass of the coil 25.

Thus to make Log 3, after the tensile loading, the operator again connects detecting circuit 62 and logging recorder 64 to the cable 40, and again passes downhole tool 25 up and down wellbore W and the bore of string S, as before. This time a somewhat different log (Log 3) is generated, one from which the three uppermost magnetic marks B of Log 2 have been erased. The operator now knows that the free point he is seeking lies somewhere below the lowermost of the three erased marks, or below about 4868 feet. It may also lie above the uppermost unerased mark B, or above 4916 feet, but before deciding that this is so he chooses to make a more precise determination by a rotary test.

As explained above, a drill string may get hung up on a bend in the wellbore in such manner that it is not free to respond to a linear lifting force but can respond to a force tending to rotate it. With this in mind, the operator between Logs 3 and 4 puts a rotary load on string S, comparable to that used for lifting it.

Again he uses the conventional equipment on the derrick floor—the rotary table and its driver. He then reconnects detecting circuit 62 and logging recorder 64 to cable 40, and again passes the downhole tool 25 through the wellbore to detect the magnetic spots.

Figure 3:
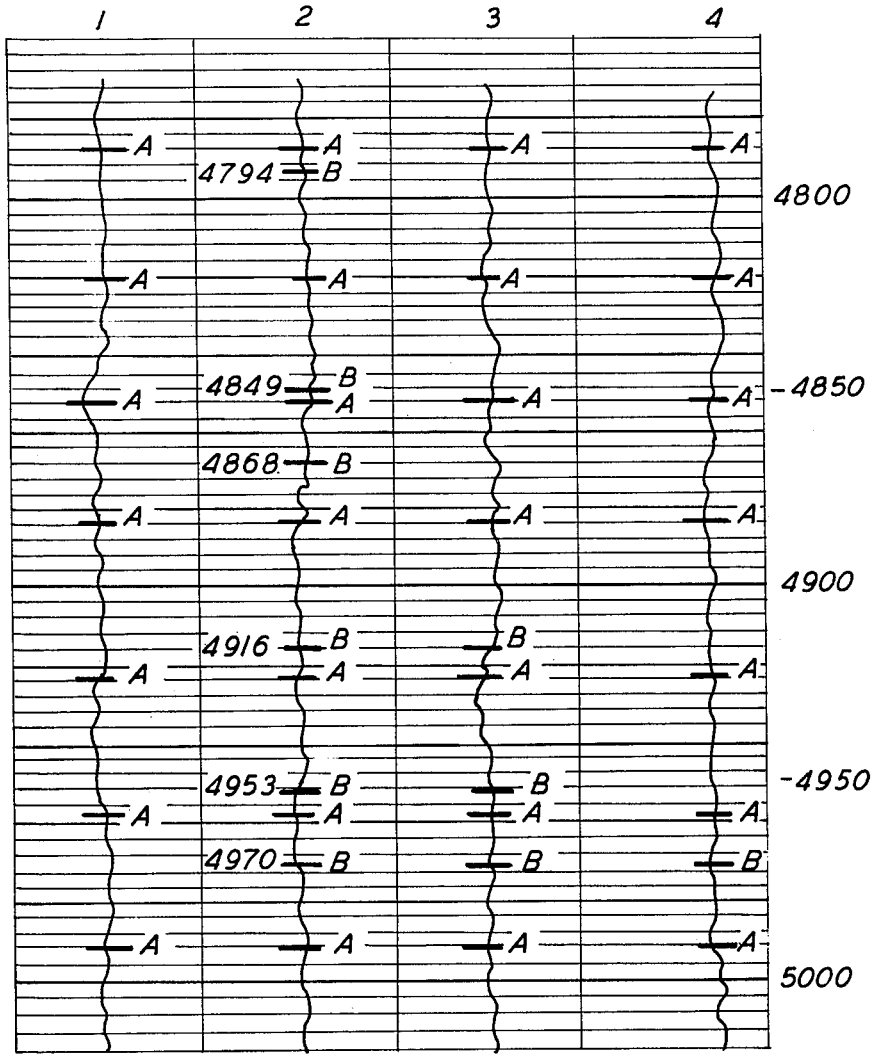
FIG. 3 is a succession of well logs produced by use of the present invention, illustrating how the present invention enables the operator to determine the free point of a string which has become stuck in a wellbore.

In the illustration of FIG. 3, the operator finds that the rotary stress has erased two additional spots B, those which had been located at 4916 feet and 4953 feet. He now knows that the free point is located between the lowermost erased mark and the uppermost non-erased mark, or between 4953 feet and 4970 feet.

While the components of the invention are for the most part well known, a word or two may need to be said about the downhole tool, the coil or inductor 25. This member may vary considerably in cross-sectional dimensions, depending on the bore of the tubular string in which it is used, from ¾-inch to 3½ inches in outside diameter. While the number of turns in the winding is probably not critical, as an example one successful embodiment used 55,000 turns of #27 copper wire. These were wrapped on a 1040 soft iron core, but an air core coil can also be used.

Having briefly described an embodiment of the invention, the inventor would point out that the drawing and description should be considered illustrative rather than limiting. The invention is limited only as set forth in the following claims, which would be construed to include all substantially equivalent means operating in a substantially similar manner to obtain substantially the same result.

What is claimed is:

1. A free point indicator for a tubular well string, said indictor comprising a running tool, surface marking apparatus and detection apparatus, and connecting means for both running the tool downhole and selectively and alternately connecting it electrically with the surface apparatuses, said running tool being adapted for running inside the tubular well string and including a sensitive coil, said marking apparatus including an electrical capacitor and switching means for connecting the capacitor to discharge its stored energy through the conecting means to pulse said coil, whereby a magnetic spot is induced at a known depth on the inner wall of the tubular string, and said detection apparatus including sensitive meter means to detect an induced voltage when said coil moves through the field of said magnetic spot.

2. In a free point indicator of the type which includes a running tool, surface marking and detection apparatus, and wire line means for running the tool downhole and connecting it electrically to the surface apparatus, the improvement comprising a running tool comprising a coil encased only in non-magnetic material, said tool being adapted for connection to an electro-mechanical cable used as such wire line and further characterized by the absence of any permanent magnet.

3. The running tool of claim 2 in which said non-magnetic encasing the coil includes a non-magnetic metal such as Monel metal or stainless steel.

4. Apparatus for detecting the free point of a tubular string stuck in a wellbore, such apparatus comprising a running tool consisting basically of a coil, surface means for generating electrical pulses for said coil, surface means for detecting induced voltages in said coil, and electro-mechanical means for passing said running tool up and down the wellbore and electrically connecting it to the surface apparatuses, said running tool being further characterized in that it includes no permanent magnets.

5. Apparatus for detecting the locations of the connections between members of a tubular string in a wellbore comprising a running tool consisting basically of a coil, a wire line of electro-mechanical cable supporting said tool and electrically connected to said coil, and a surface detection circuit electrically connected to said cable and consisting basically of a galvanometer, said running tool being free of permanent magnets.

6. A method of locating the free point of a string of tubular members stuck in a wellbore comprising the sequential steps of:

(1) running to a location within the suspected area within said string a tool consisting basically of a coil connected by cable to surface electrical equipment, (2) pulsing said coil with a burst of energy supplied from the surface through said equipment and cable, and at the same time making a well log to show the location of the coil below the surface at the time it is pulsed, (3) repeating said pulsing and logging steps for additional locations of the coil spaced from the initial location, (4) stressing the string to induce elastic tensile strain along the length thereof above the free point, and (5) running said coil past the locations whereat it was previously pulsed, and at the same time making a log showing those locations whereat a galvanometer in the surface equipment shows a reaction between coil and string, and those for which there is no such reaction.

7. The method of claim 6 in which said stressing step is a lifting of the string.

8. The method of claim 6 in which said stressing step is an attempted rotation of the string.

9. The method of claim 6 in which said stressing step is a combination of lifting and rotation.

10. The method of claim 6 which includes the preliminary step of running said coil up and down the wellbore within the suspected area of the string and at the same time recording the depth location at which a galvanometer connected by cable to the coil is caused to deflect as the result of the interaction between said coil and a connecting joint in the string.

* * * * *